United States Patent [19]

Delano

[11] Patent Number: 4,492,502

[45] Date of Patent: Jan. 8, 1985

[54] TECHNIQUE FOR PICKING UP AND LAYING DOWN PIPE

[76] Inventor: Charles G. Delano, Guaranty Bank Plaza, Corpus Christi, Tex. 78475

[21] Appl. No.: 498,738

[22] Filed: May 27, 1983

Related U.S. Application Data

[63] Continuation of Ser. No. 335,258, Dec. 28, 1981, abandoned.

[51] Int. Cl.[3] ..... E21B 19/00

[52] U.S. Cl. ..... 414/22; 414/747; 414/910; 104/112; 175/85

[58] Field of Search ..... 414/22, 745, 747, 910; 175/52, 85; 166/77.5, 85; 104/93, 112, 173 R

[56] References Cited

U.S. PATENT DOCUMENTS

| | | | |
|---|---|---|---|
| 3,713,547 | 1/1973 | Beck | 414/22 |
| 3,991,887 | 11/1976 | Trout | 414/745 X |
| 4,054,210 | 10/1977 | Crocker | 414/22 |
| 4,081,087 | 3/1978 | Freeman, Sr. | 414/22 |
| 4,082,193 | 4/1978 | Teaque | 414/22 |

*Primary Examiner*—Robert J. Spar
*Assistant Examiner*—Ken Muncy
*Attorney, Agent, or Firm*—G. Turner Moller

[57] ABSTRACT

An apparatus for picking up and laying down pipe is arranged so that pipe movement is directed toward the hole axis or rotary table. When the pipe carrier stops movement toward the hole axis, the end of the pipe joint being delivered toward the hole is positioned above the rotary table and beyond an upstanding support carried by the rig which carries the load of the pipe joint and pipe carrier.

16 Claims, 8 Drawing Figures

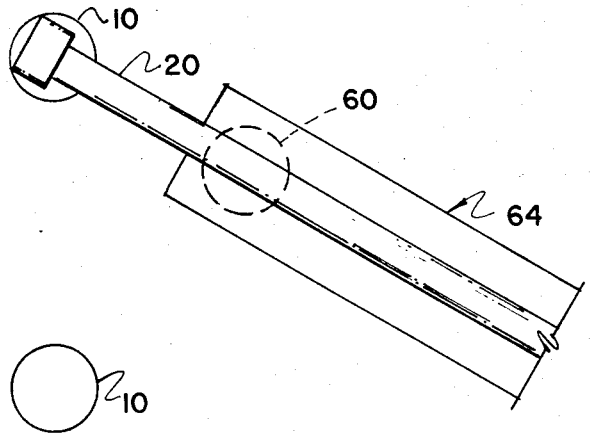
FIG. 8
FIG. 7
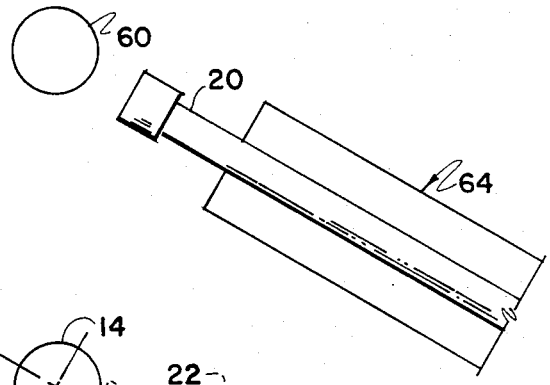
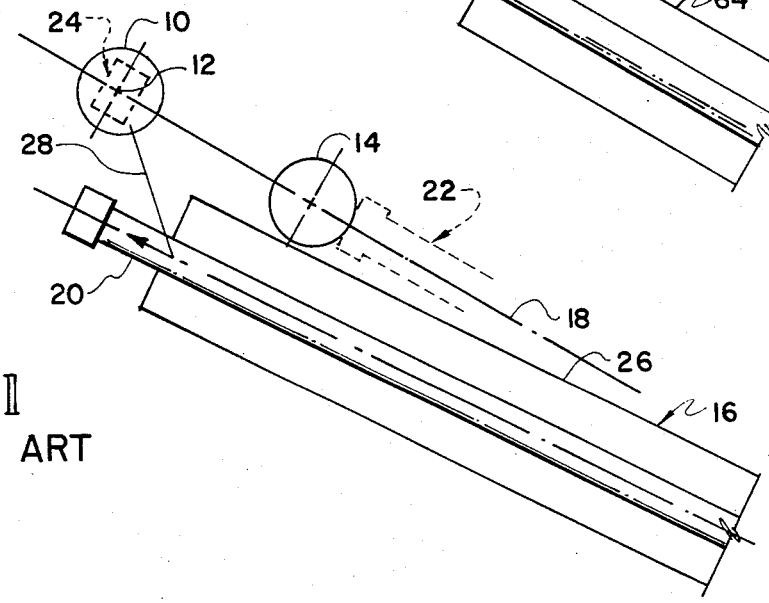
FIG. 1
PRIOR ART

TECHNIQUE FOR PICKING UP AND LAYING DOWN PIPE

This application is a continuation of application Ser. No. 335,258, filed 12/28/81, abandoned.

This invention relates to devices known in the art as laydown units. Laydown units are used in connection with drilling rigs during the drilling and completion of hydrocarbon producing wells for laying down drill pipe, which is the transporting of drill pipe from the rig floor to the catwalk. Laydown units are also used for picking up casing, which is the transporting of production or intermediate string casing from the catwalk to the rig floor.

The typical laydown unit now in use in the oil industry includes a base unit which is positioned adjacent the end of the rig catwalk. A flexible cable of substantial strength, known as a bull line, extends from the base unit to a removable upstanding support on the rig floor. A pipe carrier is supported by the bull line and means are provided on the base unit for propelling the pipe carrier toward and away from the upstanding support on the rig floor. The base unit includes means for tensioning and relaxing the bull line. By adept manipulation of the mechanisms of the base unit, the pipe carrier can be quite rapidly moved between the catwalk and the rig floor.

One of the difficulties with laydown units of the prior art resides in the relationship between the upstanding support, the rotary table and the desired termination of pipe movement during the pickup operation. The problem is shown best in FIG. 1 where a rotary table 10 defines a hole axis 12 aligned with an upstanding support 14 for a prior art laydown unit of which a pipe carrier 16 is a part. When the pipe carrier 16 is moving toward the rotary 10, it moves along a path of movement 18 which necessarily intersects the support 14. The pipe joint 20 carried by the carrier 16 would normally be stopped in the dashed line position 22 while picking up pipe. It will be seen there is a substantial distance between the rotary table 10 and the end of the pipe joint 20. The elevators 24 which are used to grapple onto the pipe joint 20 normally hang vertically above the rotary table 10. Since the pipe joint 20 normally would stop at the dashed line position 22, which is a substantial distance from the elevators 24, the elevators 24/or the pipe joint 20 must be manually moved in order to connect the elevators 24 to the pipe joint 20.

The first development to minimize manual exertion in this situation was to manually slue the pipe carrier as it approached the support 14 so that the lateral edge 26 thereof would pass along the periphery of the support 14. This would position the pipe carrier 16 in the solid line position shown in FIG. 1 and dispose the pipe joint 20 substantially closer to the normal hanging position of the elevators 24. This sluing of the pipe carrier 16 was initially effected manually by the roughnecks on the rig floor. Later, automatic means were proposed for sluing the pipe carrier so that the forward end of the pipe extends beyond the support. Disclosures of this type are found in U.S. Pat. Nos. 3,713,547; 4,054,210; 4,081,087 and 4,140,227.

Even though automatic means are provided to slue the pipe carrier, significant manual exertion is required to shift the elevators 24 to grasp the offset pipe joint 20 shown in FIG. 1. As will be evident to those skilled in the art, the elevators 24 have to be moved in the path of the bent arrow 28 in order to connect to the pipe joint 20. The elevators 24 and other equipment which will have to be moved in order to connect to the pipe joint 20 are quite heavy. Thus, considerable manual exertion is necessary to connect the elevators 24 and the pipe joint 20.

One may question why the upstanding support 14 is aligned in the path of movement 18 between the rotary 10 and the rig catwalk rather than offset to avoid this problem. The reason is that the support 14 is placed in what is called the mouse hole, which is located immediately adjacent the rotary table 10 for other purposes, as will be more fully explained hereinafter.

In the laydown unit of this invention, a base unit is provided which is positioned adjacent the end of the rig catwalk. A bull line extends from the base unit to a removable upstanding support on the rig floor. A pipe carrier is supported by the bull line and means are provided on the base unit for propelling the pipe carrier toward and away from the upstanding support on the rig floor. The base unit includes means for tensioning and relaxing the bull line. In this regard, the bull line preferably includes a pair of separate cables extending between the base unit and the upstanding support and the pipe carrier is supported by both cables. The two cables of the bull line are independently relaxable so that the operator can, in effect, lower one side of the pipe carrier to discharge pipe from either side of the carrier. By adept manipulation of the mechanisms of the base unit, the pipe carrier can be rapidly moved from the catwalk and the rig floor.

The pipe carrier and bull line are rigged so that the pipe joints supported by the carrier can extend over the top of the upstanding support toward the rotary table. In this fashion, the end of the pipe joint can be disposed immediately adjacent the rotary table so that manual pulling and hauling on the elevators is significantly reduced.

It is accordingly an object of this invention to provide an improved laydown unit.

Another object of this invention is to provide an improved laydown unit which significantly reduces the amount of manual effort required by roughnecks during picking up and laying down of pipe.

Other objects and advantages of this invention will become more fully apparent as this description proceeds, reference being made to the accompanying drawings and appended claims.

IN THE DRAWINGS

FIG. 1 is a partial top view of a prior art laydown unit illustrating the relationship between the upstanding rig support, the rotary table and the pipe joint being delivered to adjacent the rotary table;

FIG. 7 is a top view illustrating the relationship between the rotary table, the upstanding rig support, pipe joint and pipe carrier as the pipe joint approaches the rotary table during the picking up of pipe; and FIG. 8 is a view similar to FIG. 7 illustrating the relationship between the rotary table, the upstanding rig support, pipe joint and pipe carrier at the termination of carrier movement during the picking up operation.

Figure 2:
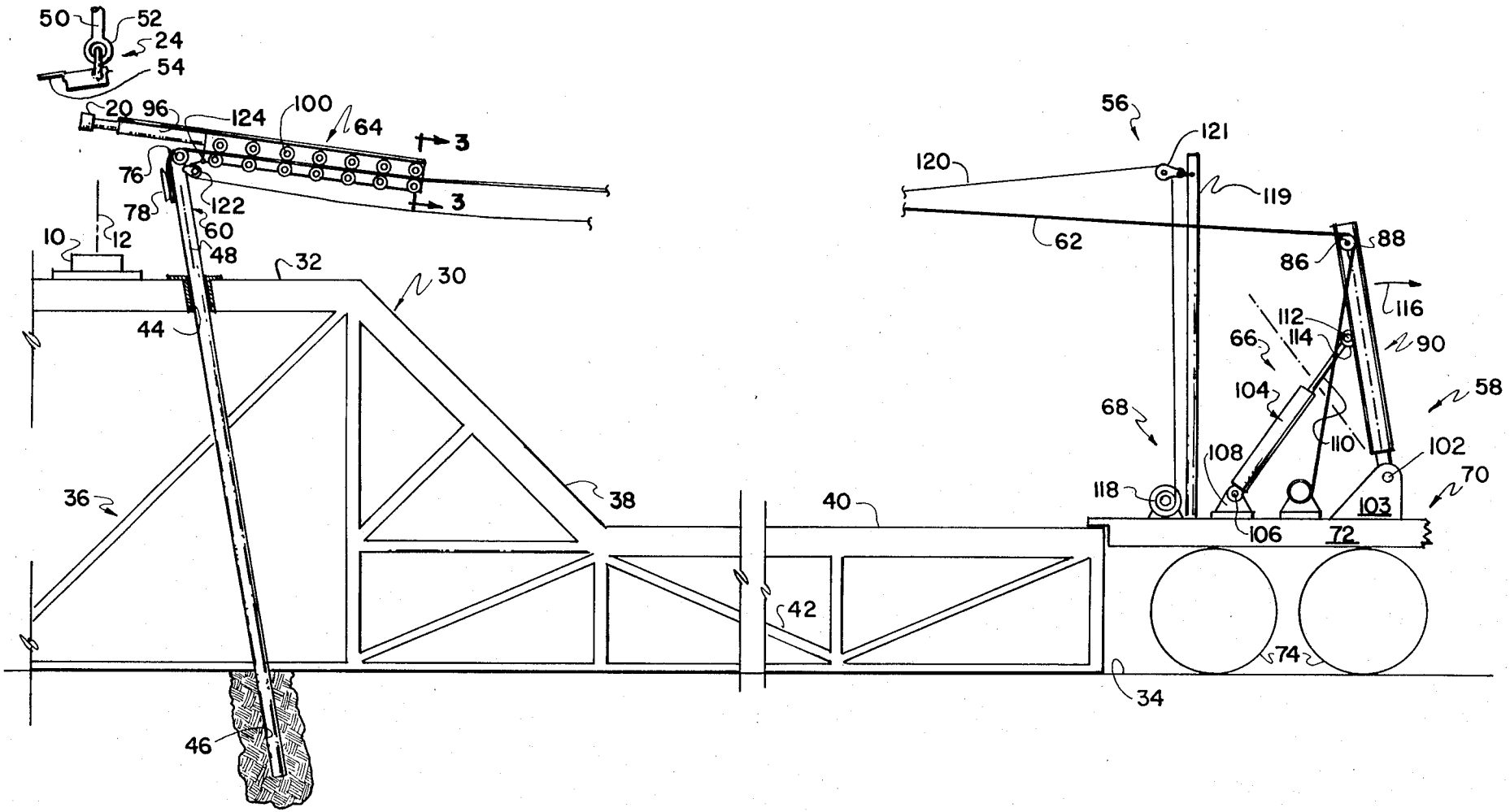
FIG. 2 is a side elevational view of the laydown unit of this invention illustrated in operative relation with a drilling rig.

Referring to FIG. 2, a typical drilling rig 30 has a rig floor 32 supported above the surface 34 of the ground by a substructure 36. A V-door ramp 38 inclines downwardly from the rig floor 32 to a catwalk 40 supported from the ground surface 34 by a framework 42. As will be evident to those skilled in the art, pipe racks (not shown) are disposed on each side of the catwalk 40 so that, during a picking up operation, pipe can be rolled onto the catwalk 40, picked up by a laydown unit and transported to the rig floor 32. The rotary table 10 is supported on the rig floor 32 and defines the hole axis 12. Typically, a blow out preventer (not shown) is disposed under the rig floor so that pipe delivered through the rotary table 10 passes through the blow out preventer and then into a portion of the well extending into the earth which has been drilled by the rig 30.

Laydown units are normally not employed on drilling rigs having a shallow depth capacity. Although there are a variety of reasons, the main reason is that the time saved in picking up or laying down 2000–3000′ of pipe is not normally justifiable. Consequently, laydown units are normally used in the drilling and completion of fairly deep wells. The rigs that are normally used to drill wells of the depth that justify laydown units typically have what is called a mouse hole 44 extending through the rig floor 32. When the rig 30 is being rigged up, a drill bit, typically on the end of the kelly (not shown) is passed through the mouse hole 44 to dig an extension 46 thereof into the earth. Typically, the mouse hole 44 and the extension 46 are called the mouse hole and are used during the course of making a connection while drilling. The total distance between the top of the rig floor 32 and the bottom of the extension 46 as measured along the axis of the mouse hole will be less than the length of a normal joint of drill pipe used by the rig 30. Accordingly, the mouse hole will be less than 30′ in length. The mouse hole opening 44 in the rig floor is usually quite close to the rotary table 10. Typically, the horizontal distance between the rotary table 10 and a vertical axis 48 defined by the mouse hole 44 is normally less than 2′.

The drilling rig 30 is also provided with means for raising and lowering pipe joints relative to the rotary 10. Such equipment normally includes a drawworks (not shown), a derrick (not shown), a crown block (not shown), a travelling block (not shown), a cable (not shown) interconnecting the drawworks, crown block and travelling block, a pair of bails 50 extending downwardly from the travelling block having eyes 52 on the end thereof and a set of elevators 24 carried by the eyes. The elevators 24 include handles 54 which are grasped by a roughneck or casing crew worker and latched onto a joint of pipe delivered by a laydown unit adjacent the rotary 10 during a picking up operation. During a laying down operation, the elevators 24 are unlatched from a joint of pipe adjacent the rotary 10 so that the pipe joint is delivered into the pipe carrier for transport toward the catwalk 40.

The laydown unit 56 of this invention comprises, as major components, a base unit 58 positioned adjacent the end of the catwalk 40, a long upstanding support 60 on the rig floor which is conveniently inserted into the mouse hole 44 and comes to rest in the extension 46, a bull line 62 interconnecting the base unit 58 and the support 60 for supporting a pipe carrier 64 during movement toward and away from the support 60, means 66 carried by the base unit 58 for tensioning and relaxing the bull line 62 and means 68 carried by the base unit 58 for propelling the pipe carrier 62 upwardly toward the rotary 10 or controlling its speed during downward movement toward the base unit 58.

Although the base unit 58 may be truck mounted or skid mounted, it is illustrated as comprising part of a trailer 70 having a bed 72 supported by a plurality of ground engaging wheels 74. Suitable power sources (not shown) such as internal combustion engines, hydraulic motors and the like, are provided on the trailer 70 for powering the various components of the base unit 58. The base unit 58 is conveniently backed up against the catwalk 40 to prevent the base unit 58 from moving toward the rig 30 during use.

Figure 4:
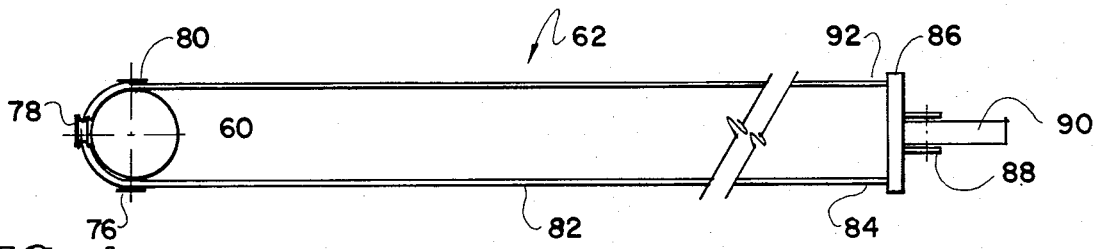
FIG. 4 is a top view of one embodiment of the bull line and its arrangement with the upstanding rig support.

The upstanding support 60 conveniently comprises an elongate support of considerable strength. Conveniently, the support 60 comprises a 30 foot length of drill collar. Since the mouse hole 44 and extension 46 are somewhat less than 30 feet in length, the upper end of the support 60 extends above the rig floor 32. As seen most clearly by a comparison of FIGS. 2 and 4, the upper end of the support 60 comprises a multiplicity of guides 76, 78, 80 for the bull line 62. As shown best in FIG. 4, the bull line 62 comprises an elongate flexible member or cable 82 which is tied off at one end 84 to a crossbar 86 pivotally connected by a clevis 88 to a post 90 comprising part of the bull line tensioning means 66 as will be more fully explained hereinafter. The cable 82 extends over the top of the guide 76, underneath the guide 78, on top of the guide 80 and reconnects at the point 92 to the crossbar 86. The guides 76, 78, 80 may conveniently comprise pulleys or the like. It will be evident that the bull line 62 is divided into two load supporting halves which are interdependent since tensioning of one of the lengths of cable necessarily tensions the other length. Because the cable 82 extends about the support 60 and is connected to the crossbar 86 at spaced locations, the two flights or lengths of the bull line 62 are spaced apart and are desirably substantially parallel in order to support the pipe carrier 64.

Figure 3:
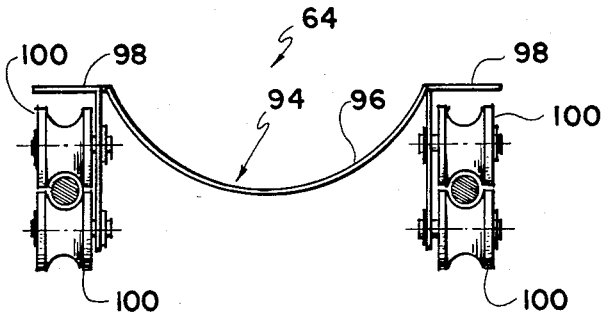
FIG. 3 is an enlarged cross-sectional view of the pipe carrier of FIG. 2, taken substantially along line 3—3 thereof as viewed in the direction indicated by the arrows.

Referring to FIG. 3, the pipe carrier 64 is illustrated in greater detail and comprises a trough shaped structure 94 comprising a central generally semi-cylindrical load support 96 and a pair of horizontal wings 98 overlying aligned pairs of pulleys or rollers 100 which captivate the cable 82 comprising the bull line 62. As shown best in FIG. 2, the forward or upper end of the semi-cylindrical structure 96 extends forwardly or upwardly from the last set of pulleys 100 to overlie the top of the upstanding support 60. In essence, the forward end of the pipe carrier 64 is cantilevered beyond the pulleys 100.

The bull line tensioning means 66 comprises the post 90 pivotally connected to the trailer 70 by a pin 102 extending through an ear 103. An extensible hydraulic motor 104 is pivotally connected by a pin 106 to an ear 108 welded to the trailer 70 and includes a rod end 110 pivotally connected by a pin 112 to an ear 114 welded to the post 90. It will accordingly be seen that delivery of hydraulic fluid to the motor 104 in one direction causes extension of the rod end 110 to move the post 90 in the direction indicated by the arrow 116 to thereby tension the bull line 62. In order to relax the bull line 62, the operator manipulates suitable controls to withdraw hydraulic fluid from the motor 104, it if is of the single acting variety, to retract the rod end 110. If the motor 104 is of the double acting type, hydraulic fluid is delivered to the rod end of the cylinder and withdrawn from the opposite cylinder end as is well know in the art.

The propelling means 68 comprises a winch 118 and post 119 on the base unit 58 and a line 120 extending over a pulley 121 on the post 119 and extending toward the upstanding support 60 and reaved over a pulley 122 to dead end on the carrier 64 by a suitable connection 124.

Operation of the laydown unit 56 should now be apparent. During the picking up operation, the pipe carrier 64 is moved downwardly along the bull line 62 until it overlies the catwalk 40 at a desired location. The operator of the laydown unit 56 then manipulates suitable controls (not shown) to withdraw hydraulic fluid from the motor 104 in order to move the post 90 in a counterclockwise direction to relax the bull line 62 and position the pipe carrier 64 on the catwalk 40.

A joint of pipe is then rolled from one of the pipe racks (not shown) adjacent the catwalk 40 onto the catwalk 40 and into the trough shaped structure 94 provided by the pipe carrier 64. The laydown unit operator then manipulates suitable controls (not shown) to deliver hydraulic fluid to the motor 104 thereby moving the post 90 in the direction shown by the arrow 116 to tension the bull line 62 and elevate the pipe carrier 64 and the pipe joint 20 carried thereby.

At or about the time the bull line 62 becomes fully tensioned, the laydown unit operator then energizes the winch 118 to wind up the cable 120 thereby moving the pipe carrier 64 to the left as viewed in FIG. 2. As shown in FIG. 7, the pipe carrier 64 approaches the upstanding support 60, which is aligned with the rotary table 10 in the path of movement of the pipe carrier 64. The laydown unit operator then brakes the winch 118 to cause the pipe carrier 64 to stop in the position shown in FIGS. 2 and 8.

With the pipe carrier 64 in the position shown in FIG. 2, the driller manipulates the draw works brake to allow the elevators 24 to descend upon the end of the pipe joint 20 extending beyond the confines of the pipe carrier 64. It is a relatively easy matter to latch the elevators 24, as by a roughneck grasping the handles 54 and pulling them together. The driller then manipulates the drawwork controls (not shown) to wind up the load line and elevate the travelling block. This causes the elevators 24 to rise thereby picking up the pipe joint 20.

At or about the time the pipe joint 20 clears the pipe carrier 64, the laydown unit operator manipulates the winch controls (not shown) to drive the winch 118 in an opposite direction to allow the pipe carrier 64 to gravitate toward the right along the bull line 62. When the pipe carrier 64 reaches its desired position along the catwalk 40, the laydown unit operator manipulates suitable controls (not shown) to withdraw hydraulic fluid from the motor 104 thereby moving the post 90 in a counterclockwise direction to relax the bull line 62 and drop the pipe carrier 64 onto the catwalk 40. Another joint of pipe may be rolled into the trough like structure 94 and the process repeated.

In a laying down operation, the process is substantially the same even though the direction of pipe transportation is reversed. Basically, the pipe carrier 64 is pulled upwardly along the bull line 62 to adjacent the rotary table 10. During its reverse movement, the pipe carrier 64 is allowed to gravitate downwardly along the tensioned bull line 62.

Figure 5:
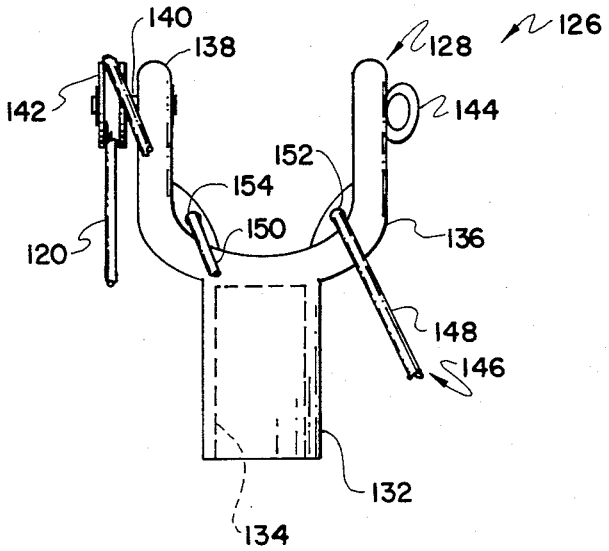
FIG. 5 is a front view of another embodiment of the upstanding support and bull line in accordance with this invention.
Figure 6:
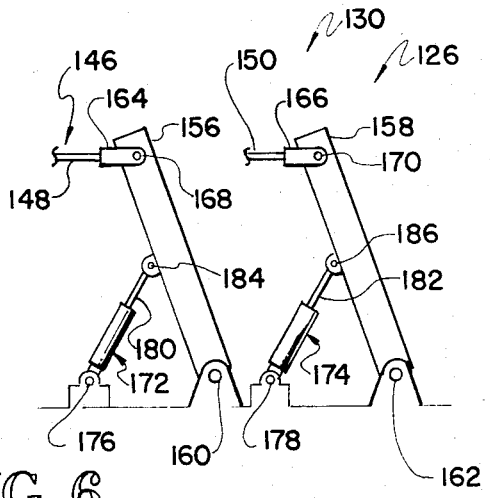
FIG. 6 is a bull line tensioning mechanism usuable with the device of FIG. 5.

Referring to FIGS. 5 and 6, there is illustrated another embodiment of a laydown unit 126 of this invention. In FIG. 5, an upstanding support 128 may be welded onto the top of a drill collar or may comprise a central sleeve 132 having a blind passage 134 therein for receiving the top of a drill collar. The drill collar portion of the support 128 extends through the mouse hole 44 as in the embodiment of FIG. 2. The support 128 is generally of yoke shape having a pair of upstanding arms 136, 138 spaced apart to define a passageway therebetween to receive part of the pipe carrier 64 illustrated in FIGS. 2 and 3. Mounted on the arm 138 is a stub shaft 140 carrying a pulley 142 thereon about which is looped the cable 120 for propelling the pipe carrier 64 toward the upstanding support 128. An eye 144 is secured to the arm 136 in any suitable fashion, as by welding or the like to receive a chain or other tie down device (not shown) for tying the arm 136 to a derrick leg (not shown) to prevent the support 128 from rotating during use. In the embodiment of FIGS. 5 and 6, there is provided a bull line 146 comprised of a pair of separate cables 148, 150 which are connected to the support 128 in any suitable fashion as by passing through aperatures 152, 154 and providing an enlargement (not shown) on the other side thereof.

As shown best in FIG. 6, the bull line tensioning mechanism 130 comprises a pair of posts 156, 158 pivotally mounted to the base unit by a pin 160, 162. The bull line cables 148, 150 are connected respectively to the posts 156, 158 by a clevis 164, 166 and pivot pins 168, 170. In order to independently tension the cables 148, 150, the bull line tensioning mechanism 130 comprises a pair of hydraulic motors 172, 174 pivotally connected to the laydown base unit by a pin 176, 178 and including a rod end 180, 182 respectively pivotally connected to the posts 156, 158 by a pin 184, 186.

Suitable controls are provided for simultaneously extending and withdrawing the rods 180, 182 of the hydraulic motors 172, 174. Similar controls (not shown) are provided for independently extending and withdrawing the rod ends of each of the motors 172 174. With both of the bull line cables 148, 150 tensioned because of extension of the motors 172, 174, one of the motors can be retracted to relax only one of the cables 148, 150. This has an important effect as explained more fully hereinafter.

In the picking up mode of operation, the laydown unit 126 operates in virtually the same manner as the laydown unit 56. Suitable controls (not shown) are desirably provided for delivering hydraulic fluid simultaneously to the motors 172, 174 for tensioning the bull line cables 148, 150 substantially simultaneously.

In the laying down mode of operation, the laydown unit 126 can be made to operate somewhat differently than the unit 56. The following discussion assumes that the viewer is standing on the base unit facing the rotary table 10 of the rig 30. After a pipe joint 20 has been at least partially set into the pipe carrier 64, the operator manipulates suitable controls (not shown) to drive the winch 118 to allow the pipe carrier 64 to gravitate downwardly along the bull line 146. As the pipe carrier 64 approaches the location above the catwalk 40 where it is desired to discharge pipe from the pipe carrier 64, the operator manipulates a control (not shown) to retract one of the motors 172, 174 depending on which way the operator desires the pipe joint to roll. For example, if the operator desires the pipe joint 20 to roll to the right, the motor 172 is first retracted to cause the cable 148 to relax. This causes the pipe carrier 64 to tilt to discharge the pipe joint 20 to the right. If the operator desired the pipe joint to roll to the left, the motor 174 would be retracted first in order to relax the bull line cable 150.

Since tilting the carrier 64 discharges the pipe joint therefrom, reverse movement of the pipe carrier 64 upwardly along the bull line 126 may be commenced as soon as the pipe joint 20 rolls out of the carrier 64. This may, of course, occur before the relaxed bull line cable is retensioned since the other cable remains tensioned and is clearly adequate to support the empty pipe carrier during upward movement toward the rotary table 10.

The foregoing disclosure and discription of the invention are illustrative and explanatory thereof, and various changes in the size, shape and material as well as in the details of the preferred embodiment may be made without departing from the spirit and scope of the invention as hereinafter claimed.

I claim:

1. A laydown unit for transporting pipe joints between a first location and a rig floor providing a rotary table at a higher elevation, comprising an upstanding support on the rig floor between the rotary table and the first location;

a base unit and a bull line extending between the base unit and the upstanding support;

a pipe carrier, supported on the bull line, including means for supporting a joint of pipe;

means for propelling the pipe carrier from the first location toward the rotary table; and means for moving the pipe joint over the top of the upstanding support to deliver the pipe joint adjacent the rotary table.

2. The laydown unit of claim 1 wherein the first location, upstanding support and rotary table are aligned in a path and the pipe carrier is linearly movable along the path.

3. The laydown of claim 1 wherein the moving means comprises means for moving the pipe joint to a location over the rotary table.

4. The laydown unit of claim 1 wherein the bull line comprises a pair of spaced flexible load supporting member and further comprising means for independently relaxing the members.

5. The laydown unit of claim 4 wherein the spaced load supporting members are secured to the support.

6. The laydown unit of claim 1 wherein the bull line comprises a flexible load supporting member extending about the upstanding support, the upstanding support comprises means for guiding the load supporting member about the support and further comprising means connected to the load supporting member for tensioning the same.

7. A laydown unit for transporting pipe between a first location and a rig floor providing a rotary table at a higher elevation, comprising an upstanding support on the rig floor between the rotary table and the first location;

a base unit and a bull line comprising a pair of spaced independent elongate flexible members extending between the base unit and the upstanding support;

a pape carrier, supported on the spaced flexible members, including means for supporting a point of pipe;

means for propelling the pipe carrier from the first location toward the upstanding support and means for independently tensioning and relaxing the spaced flexible members;

the upstanding support comprises means for moving the pipe joint over the top of the upstanding support during movement toward the rotary table.

8. The laydown unit of claim 7 wherein the upstanding support comprises a central support, the flexible members being affixed to the support on opposite sides of the central support.

9. The laydown unit of claim 8 wherein the tensioning and relaxing means comprises first means for tensioning and relaxing one of the flexible members and second means, independent of the first means, for tensioning and relaxing the other flexible member.

10. The laydown unit of claim 1 wherein the last mentioned means comprises a yoke connected to the upstanding support and having first and second spaced arms extending upwardly from the upstanding support, the pipe carrier moving between the arms during movement toward the rotary table.

11. The laydown unit of claim 10 wherein the bull line is connected to the yoke arms.

12. The laydown unit of claim 1 wherein the last mentioned means comprises means mounting the pipe carrier on top of the bull line, the bull line being connected to the upstanding support adjacent the upper end thereof.

13. A laydown unit for transporting pipe joints between a first location and a rig floor providing a rotary table at a higher elevation, comprising an upstanding support on the rig floor between the rotary table and the first location;

a base unit and a bull line extending from the base unit toward the upstanding support;

means carrier by the upstanding support for connection to the bull line;

a pipe carrier, supported on the bull line, including means for supporting a joint of pipe;

means for propelling the pipe carrier from the first location toward the rotary table; and means for moving the pipe joint over the top of the upstanding support to deliver the pipe joint adjacent the rotary table.

14. The laydown unit of claim 13 wherein the last mentioned means comprises a yoke connected to the upstanding support and having first and second spaced arms extending upwardly from the upstanding support, the pipe carrier moving between the arms during movement toward the rotary table.

15. The laydown unit of claim 14 wherein the bull line connection means comprises the yoke arms.

16. The laydown unit of claim 13 wherein the last mentioned means comprises means mounting the pipe carrier on the top of the bull line, the bull line connection means comprising means connecting the bull line to the upstanding support adjacent the upper end thereof.

* * * * *